United States Patent [19]

Demmers

[11] 4,033,056

[45] July 5, 1977

[54] SPUD GUIDE MEANS IN A DREDGING VESSEL

[75] Inventor: Arie Adolf Demmers, Alblasserdam, Netherlands

[73] Assignee: Bos Kalis Westminster Group N.V., Sliedrecht, Netherlands

[22] Filed: Dec. 15, 1975

[21] Appl. No.: 640,568

[30] Foreign Application Priority Data

Dec. 18, 1974 Netherlands ..... 7416509

[52] U.S. Cl. ..... 37/73; 61/93; 115/9

[51] Int. Cl.[2] ..... E02F 3/90

[58] Field of Search ..... 37/73; 115/9; 61/46.5, 61/93, 98; 180/8 R, 8 C, 8 D, 8 E

[56] References Cited

UNITED STATES PATENTS

| | | | |
|---|---|---|---|
| 879,345 | 2/1908 | Wilson | 37/73 |
| 1,792,065 | 2/1931 | Bowers | 37/73 |
| 3,003,454 | 10/1961 | Shatoska et al. | 37/73 X |
| 3,135,345 | 6/1964 | Scruggs | 180/8 E |
| 3,283,516 | 11/1966 | DeLong et al. | 61/46.5 |
| 3,335,809 | 8/1967 | Guinot | 180/8 R |
| 3,821,859 | 7/1974 | McWalters | 37/73 X |

FOREIGN PATENTS OR APPLICATIONS

| | | | |
|---|---|---|---|
| 176,792 | 5/1923 | United Kingdom | 37/73 |

*Primary Examiner*—Clifford D. Crowder
*Attorney, Agent, or Firm*—Cushman, Darby & Cushman

[57] ABSTRACT

A dredging vessel has a vertically elongated spud guide in a well in the vessel, the guide being supported for horizontal movement in the well and for swinging movement in a vertical plane. Vertically spaced apart horizontal jacks are connected between the guide and the vessel.

6 Claims, 6 Drawing Figures

SPUD GUIDE MEANS IN A DREDGING VESSEL

The present invention relates to a spud system for a dredger, comprising at least one spud which is vertically movable in a guide, said guide being supported by support means in vertical direction with respect to the vessel, while means are provided for moving the guide with supporting means and the spud in longitudinal direction relative to the vessel, said means including at least one jack or winch operative in horizontal direction.

An apparatus of this type is described in British Pat. No. 330,837. In this patent the spud is held in a vertical guide arranged in a spud carriage. This spud carriage is movable by means of lead screws arranged on opposite sides in longitudinal direction thereof with the aid of a common drive. Furthermore means are provided to tilt the spud from its vertical into a horizontal position.

The general construction of a dredger having two spuds mounted in fixed guides on the stern is described, for example, in U.S. Pat. No. 3,272,477 to Fred J. Schmidt. For arranging the spuds in the stern of a dredger, reference is also made to U.S. Pat. No. 3,495,409. Known per se details can also be derived from U.S. Pat. Nos. 2,064,440 to Schaefer and 2,917,851 to Charles E. Ellicott.

Furthermore it is known to resiliently support a spud carriage on a number of parallel wheel pairs, while the spud is movable in fixed guides on the spud carriage for vertical movement and wherein the carriage itself can perform relative movements relative to the vessel by means of the resilient supports.

It is also known to construct a guide for a spud in convex disc form and to suspend this guide in a vessel by means of a number of vertical hydraulic cylinders. The hydraulic cylinders are thereby operative as movement dampening means.

The object of the invention is to provide an improved spud system of the type defined above, which takes up forces occurring between dredger and spud effectively and prevents particularly also horizontal forces and moments from leading to excessive vertical forces in the supporting system.

To this end it is proposed for such a spud system to provide the spud guide with at least two vertically spaced guide portions, a first horizontally operative jack or winch being connected to the upper portion of the guide, and a second jack or winch being connected to the lower portion of the guide. By this the forces and moments occurring between the spud and the vessel can be taken up by horizontal forces, possibly of different magnitude, in the two jacks. These jacks can be mounted in a simple way adjacent to the deck or adjacent to the bottom or between-decks of the vessel so that the occurring forces can easily be led into the structural parts of the vessel. The two guide portions can thereby be connected by a spud guide sleeve resting at its upper end on a single cross axle with wheels. Thus, in case of deviations from the vertical position of the spud relative to the vessel deck a tilting movement around the single wheel pair will be performed, as a result of which these deviations in position will not lead to extra vertical loads on the wheels.

It is observed that as a jack both a screw jack, a cable winch construction and a hydraulic cylinder assembly can be used. For the support of the spud guide with respect to the vessel use can be made both of wheels and of slides, so that both vertical and horizontal forces can be taken up.

To effect displacement of the vessel relative to the spud, the two jacks are simultaneously expanded and extracted. With this displacement the spud will keep assuming a vertical position. The drive of the two jacks can also be arranged so that a differential displacement is possible. Hence the spud can be operative as a tilting spud, if so desired.

Instead of a guide sleeve for the spud which is secured to the lower and the upper guide portion can also be vertically supported, while the lower support portion is suspended therefrom by means of hinge rods and is connected to the lower jack. If desired, there may also be provisions for taking up relative displacements in transverse direction of the spud guide relative to the vessel. As only slighter displacements need to be taken up here, relatively short jacks, dampening means or the like will suffice.

The invention will now be elucidated in more detail with reference to the schematical drawing showing a few embodiments by way of example.

Figure 1:
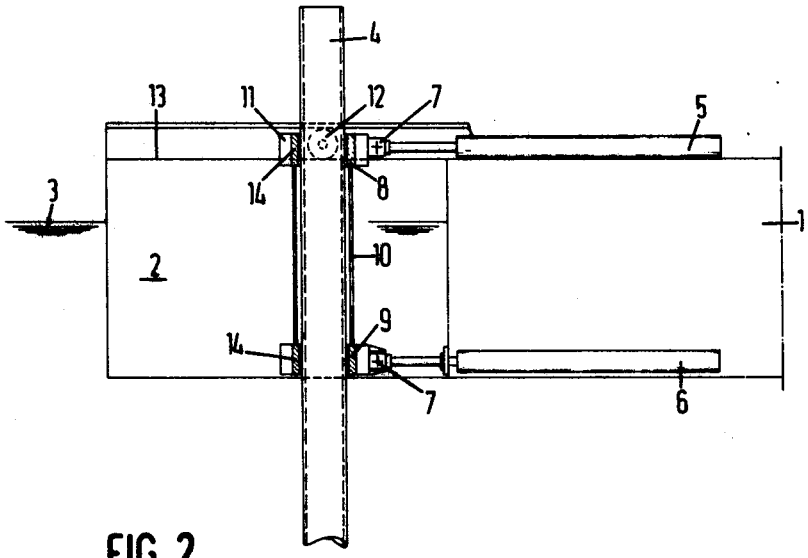
FIG. 1 shows in side elevational view, partly in sectional view, the rear part of a dredger provided with a spud system according to the invention.

A dredger generally indicated by 1 is only schematically shown in the drawings and besides only the rear part thereof. In said rear part a well 2 is provided. The water or sea level is indicated by 3. In the well a spud 4 is movable and fixable. For the horizontal displacement of the spud relative to the vessel use is made of an upper hydraulic jack 5 and lower hydraulic jack 6. The piston rods of said jacks engage pivotally at 7 an upper or lower spud guide portion 8 or 9, respectively, which are interconnected by means of a sleeve 10 which is possibly dividable. The upper spud guide portion 8 is included in a frame 11. This frame rests via two wheels 12 on horizontal track rails 13 beside the well 2 in the after end of the vessel. The axes of these two wheels are co-extensive and intersect preferably at least approximately the vertical axis of the spud. Spud 4 is confined in guide portion 8 and 9 by means of a clip 14. The frame 11 includes side beams 15. Between the frame and these side beams, support means 16, such as rubber pads, hydraulic cylinders or the like are provided for resilience in transverse direction.

The non-shown lower end of the spud is rammed into the bottom or lowered into same under its own weight. The drawings do not show the further particulars for lifting and lowering the spud, because these are generally known in the art. Neither is an auxiliary spud with a guide shown at the rear end of the vessel. Also such an auxiliary spud is generally known in the art.

Spud 4 must transfer the considerable reaction forces resulting from the operation of the dredger to the bottom in such a manner that the dredger remains stationary or only performs controlled movements. Considerable forces, particularly moments, can thereby be transferred to the vessel at the guide portions. By applying at least two jacks at a considerable space above one another these forces and moments in the vessel can be converted into forces in the horizontal plane. By placing cylinder 5 adjacent the ship's deck and cylinder 6 adjacent the bottom it is possible to obtain a simple passing on to the ship's construction. By moving cylinders 5 and 6 synchronously it is possible, while maintaining the usually vertical position of the spud, to move the vessel forward or rearward. In that case there will be no or hardly any moments acting on the point of the spud rammed into the bottom. Such moments cannot in all circumstances be taken up by the bottom and in certain conditions they are even undesirable.

Figure 3:
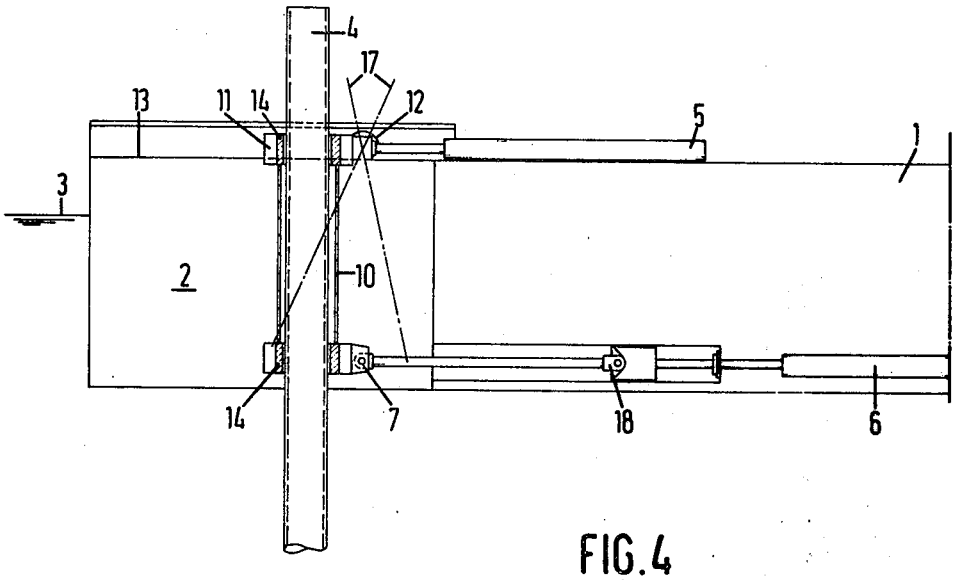
FIG. 3 is a side elevational view in accordance with FIG. 1 of a variant embodiment.
Figure 4:
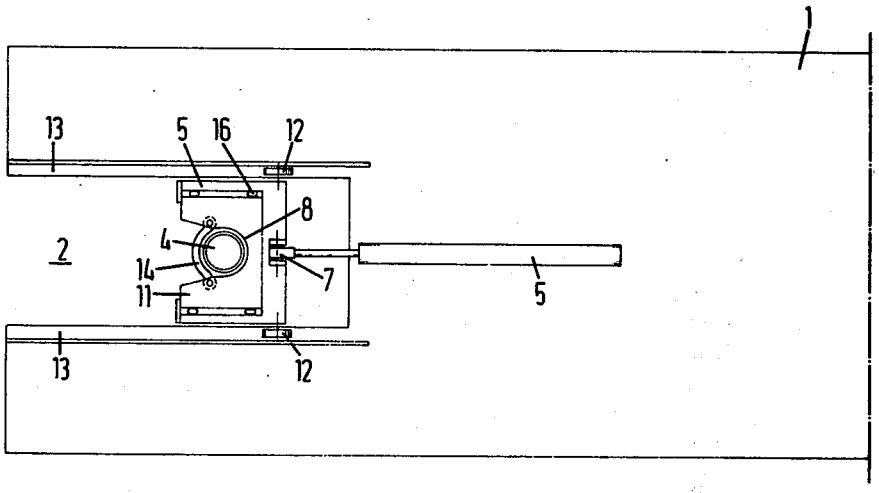
FIG. 4 is a plan view thereof.

Insofar as a swivelling movement of the spud in the vertical plane is permissible with a view to the bottom condition, provisions can be made in accordance with FIGS. 3 and 4 for moving the two hydraulic jacks 5 and 6 unevenly. Spud 4 can thereby assume an oblique position, tilting about the axis defined by wheels 12 to the positions shown by broken lines 17. The lower pivot 7 will be subjected to a displacement in vertical direction. To take up this displacement, an additional pivot 18 in the connection to the piston rod of the lower jack 6 is used. The pivot 18 forms part of a guide sleeve. Also in this construction the moments to be taken up do not have great vertical forces in the support for their result.

Figure 2:
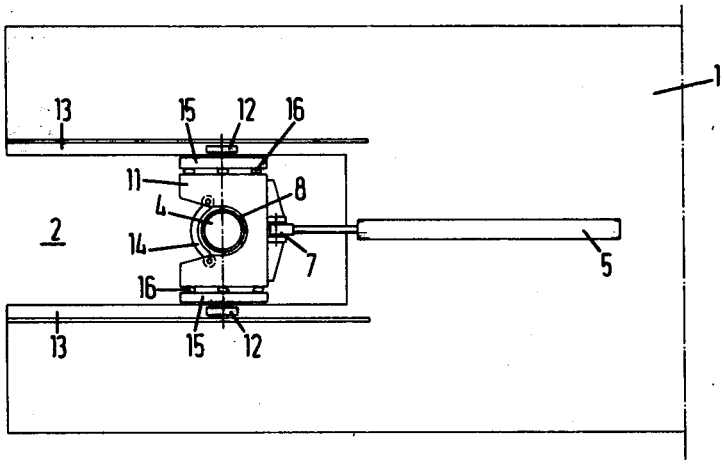
FIG. 2 is a plan view of the embodiment shown in FIG. 1.
Figure 5:
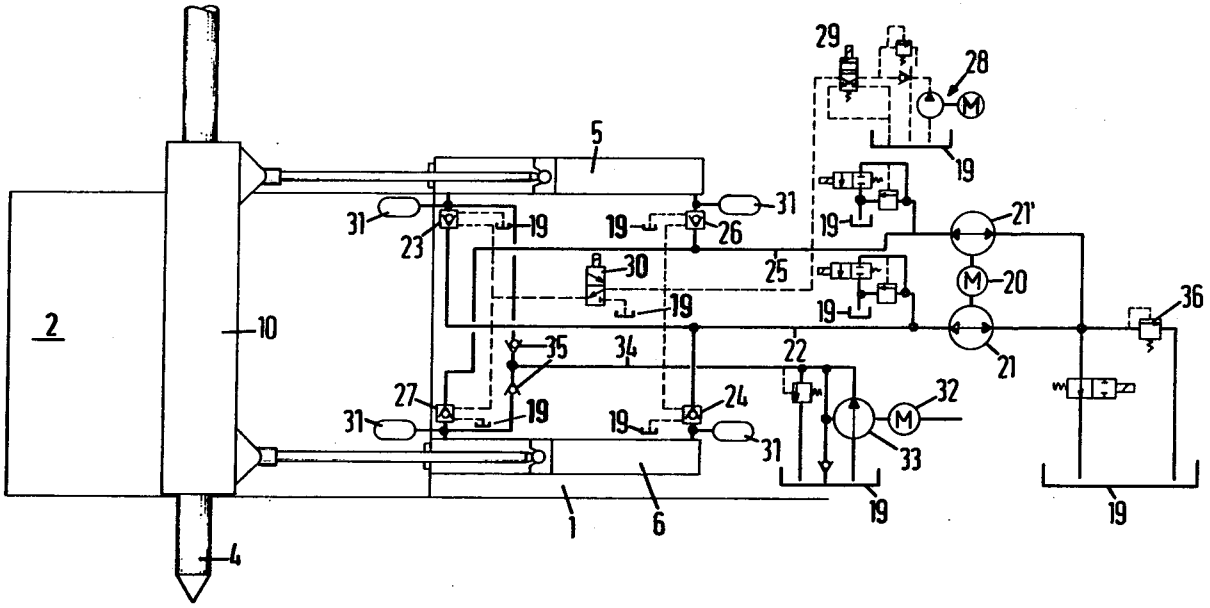
FIG. 5 shows a hydraulic drive and control system for the embodiment shown in FIGS. 1 and 2 and FIG. 6 is a corresponding scheme for the embodiment shown in FIGS. 3 and 4.

FIG. 5 shows a hydraulic control system for the construction shown in FIGS. 1 and 2. From a hydraulic reservoir, generally indicated by 19, oil is sucked by means of motor 20 and hydraulic pumps 21 and 21' synchronously driven thereby. The oil of pump 21 flows via a line 22 and via a controlled valve 23 to the cylinder space before the piston in jack 5, and also via a controlled valve 24 to the cylinder space behind the piston in jack 6. The hydraulic pump 21' pumps oil via a line 25, via a controlled valve 26 behind the piston in jack 5 and via a controlled valve 27 before the piston in jack 6. For the operation of valves 23 and 24 or 26 and 27 use is made of a hydraulic feed system with motor and pump 28, hydraulic switch valve 29 and a second hydraulic switch valve 30. The various hydraulic line, control and safety equipment is shown schematically in the usual way.

Connected to the line between each of controlled valves 23, 24, 26, 27 and the associated cylinder part there is an accumulator by means of which shocks in the system are absorbed. The well-known nitrogen-filled hydropneumatic dampener means can be used therefor. Owing to the synchronous operation of pumps 21 and 21' an equal quantity of oil will be pumped via the two lines 25 and 22. During expansion of the jacks the hydraulically controlled non-return valves 23, 24, 26 and 27 are always open. As a result of the difference in surface on both sides of the piston in jacks 5 and 6 the greatest force will consequently be exerted in the cylinder spaces behind the pistons, so that the pistons will be urged outwardly at equal speed. When the spud guide portions must be drawn backwardly with the spud, an electrically controlled valve 30 in the control line for valves 23 and 27 is no longer energized. Hence valves 23 and 27 remain closed. By means of a motor 32 and a hydraulic pump 33 oil can be pumped via a line 34 and non-return valves 35 to the front end of the two pistons of jacks 5 and 6. Motor 20 can thereby be disconnected, while the oil is returned from the back end of the pistons via non-return valves 24 and 26 which are open under the influence of the still energized switch valve 29 and via lines 22 and 25, respectively, to reservoir 19. To prevent the spud guide portions from reaching their end position at too high a speed upon withdrawal, a brake valve 36 can be used, which is operated when the end positions are nearing.

Figure 6:
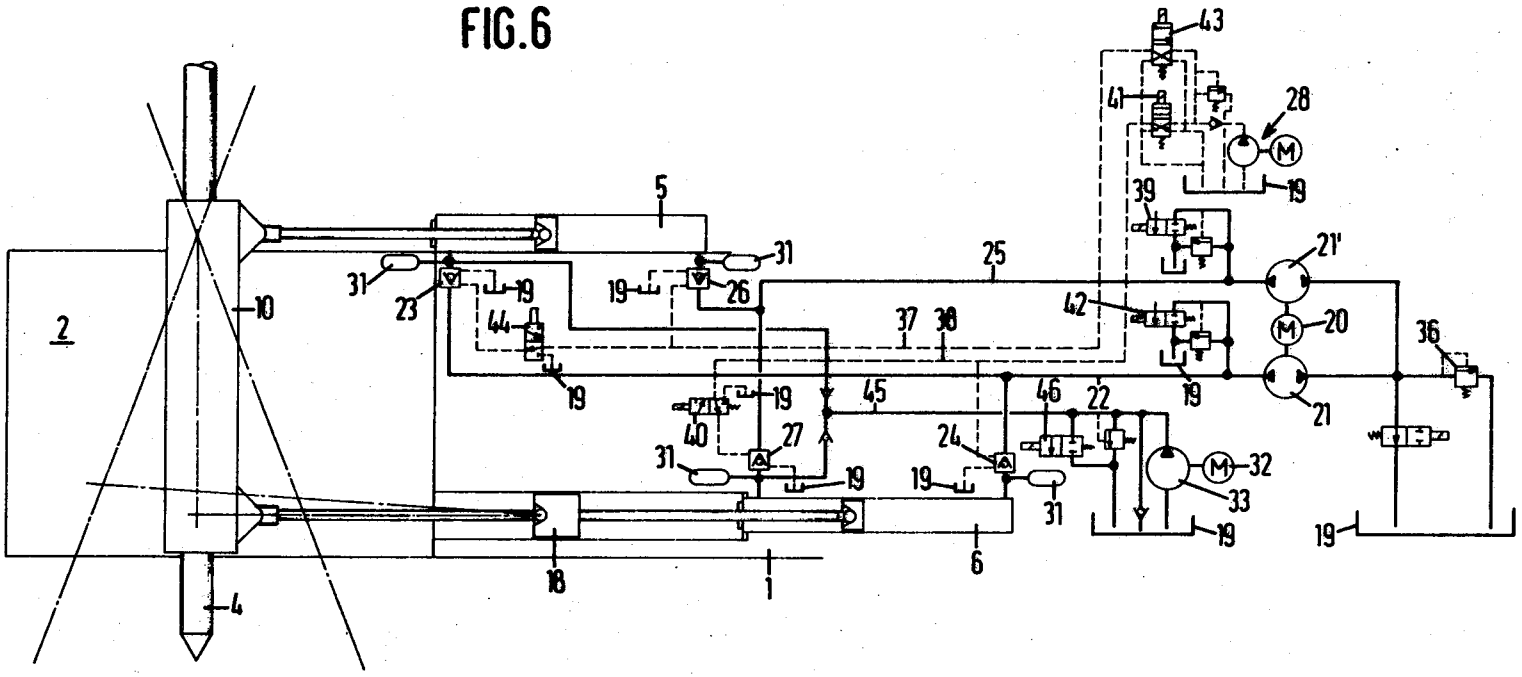

FIG. 6 shows a scheme in accordance with FIG. 5, but in this case for the spud system shown in FIGS. 3 and 4, with which a spud cannot only be moved in vertical position relative to the vessel but in which also a tilting movement of the spud about the wheel pair of the upper spud guide portion is possible. Corresponding parts are shown with the same reference numerals as in FIG. 5. The most important differences with respect to FIG. 5 are that valves 26 and 23 or 24 and 27 are controlled by separate control lines 37 and 38, respectively. Hence it is possible to keep both valves 26 and 23 closed, so that the piston in the hydraulic cylinder 5 is fixed and owing to the operation of jack 6 the apparatus can be used as a tilting spud. To obtain a displacement of the vessel in forward direction, the piston in cylinder 6 must be moved to the left, which is effected by pressing with pump 21 oil to the right-hand side of the piston, during which valve 23 is closed and valve 24 is open. Due to the synchronous drive of pump 21' this pump tends to press oil to the left-hand side of the piston of cylinder 6. To prevent this, the electrically controlled valve 39 connected to line 25 is opened, so that the oil flows directly to reservoir 19. The redundant oil on the front end of the piston in cylinder 6 also flows to reservoir 19.

In order to withdraw the piston in cylinder 6, pump 33 is operated again. Valve 27 is thereby closed in that the associated switch or control valve 40 is not energized. However, valve 24 is opened, as the electric switch valve 41 is energized. The surplus oil on the right-hand side of the piston in cylinder 6 can also flow back via the electrically opened valve 42 from line 22 to reservoir 19. Switch valve 43 operates in the same way as control valve 41 for controlling the supply of oil in line 37 of the control oil circuit. It is noted that the electrically controlled switch valve for the controlled valve 23 is indicated by 44. An electrically controlled valve in pressure line 45 of pump 33 is furthermore indicated by 46.

I claim:

1. A dredger having in its after-deck a well;
in the well a horizontal guide path;
at least one spud;
spud guide means for receiving the at least one spud for vertical movement; support means for vertically supporting the spud guide means relative to the horizontal guide path in the well;
at least two vertically spaced horizontal jacks, said jacks being at one end fixed to the vessel and having the other end connected to the spud guide means in spaced relationship;
control means in the vessel for controlling the jacks independently of each other.

2. A dredger according to claim 1, wherein the support means for the spud guide means are formed by two wheels, the axes of rotation of which are co-extensive and which wheels rest on the horizontal guide path in the well in the after end of the vessel.

3. A dredger according to claim 1, wherein the spud guide means are formed by an upper guide portion which is supported on the horizontal guide path in the well and with which the upper jack engages, and a lower guide portion with which the lower jack engages, while the connection between the lower jack and the lower part of the spud guide comprises at least two pivots acting in the vertical plane.

4. A dredger according to claim 1, further including resilient members between the spud guide means and the support means for permitting a tilting moment of the spud relative to the support means and the vessel.

5. A dredger according to claim 1, wherein the jacks are hydraulic jacks, the control means for controlling the jacks being provided with a switch valve having at least two positions for optionally displacing the two jacks synchronously or independently of each other.

6. In a dredging vessel having a well in its after-deck: vertically extending spud guide means in said well for surrounding a spud; means in said well forming a horizontal guide path; support means connected to said spud guide means and suspending the latter from said horizontal guide path for movement therealong in a vertical plane and for swinging movement in said vertical plane; a first horizontal jack pivotally connected at one end to said spud guide means near the upper end thereof and connected at the other end to said vessel; a second horizontal jack pivotally connected at one end to said spud guide means near the lower end thereof and connected at the other end to said vessel.

* * * * *